US007088242B2

(12) United States Patent
Aupperle et al.

(10) Patent No.: US 7,088,242 B2
(45) Date of Patent: Aug. 8, 2006

(54) COLLECTIVE PERSONAL ARTICLES TRACKING

(75) Inventors: Bryan Eric Aupperle, Cary, NC (US); James Merwin Mathewson, II, Chapel Hill, NC (US)

(73) Assignee: International Business Machines Corporation, Armonk, NY (US)

( * ) Notice: Subject to any disclaimer, the term of this patent is extended or adjusted under 35 U.S.C. 154(b) by 393 days.

(21) Appl. No.: 10/663,639

(22) Filed: Sep. 16, 2003

(65) Prior Publication Data

US 2005/0068170 A1 Mar. 31, 2005

(51) Int. Cl.
*G08B 1/08* (2006.01)

(52) U.S. Cl. ..... 340/539.32; 340/572.1; 340/539.11; 340/539.23

(58) Field of Classification Search ..... 340/539.32, 340/539.13, 572.1, 539.1, 573.1, 539.11, 340/539.15, 539.16, 539.17, 539.21, 539.22, 340/539.23, 539.26
See application file for complete search history.

(56) References Cited

U.S. PATENT DOCUMENTS

| | | | | |
|---|---|---|---|---|
| 6,353,390 | B1 * | 3/2002 | Beri et al. | 340/572.1 |
| 6,433,685 | B1 * | 8/2002 | Struble et al. | 340/571 |
| 6,552,661 | B1 * | 4/2003 | Lastinger et al. | 340/572.1 |
| 6,727,810 | B1 * | 4/2004 | Martin et al. | 340/506 |
| 6,747,555 | B1 * | 6/2004 | Fellenstein et al. | 340/524 |
| 6,900,731 | B1 * | 5/2005 | Kreiner et al. | 340/572.1 |
| 6,917,290 | B1 * | 7/2005 | Land | 340/539.1 |

* cited by examiner

*Primary Examiner*—Toan N. Pham
(74) *Attorney, Agent, or Firm*—Jeanine S. Ray-Yarletts, Esq.; Steven M. Greenberg, Esq.; Carey, Rodriguez, Greenberg

(57) ABSTRACT

A method, system and apparatus for collectively tracking a lost, misplaced or stolen personal article. The method can include distributing a multiplicity of tracking processors to corresponding subscribers in a personal article tracking community. An indication can be received from one of the subscribers in the community that a personal article having an RFID tag has fallen out of range of a tracking processor associated with the one of the subscribers. An identifier for the RFID tag can be forwarded to other subscribers in the community. Subsequently, notification can be received from at least one of the other subscribers that the RFID tag has been sensed in proximity to a tracking processor coupled to the at least one of the other subscribers.

17 Claims, 4 Drawing Sheets

COLLECTIVE PERSONAL ARTICLES TRACKING

BACKGROUND OF THE INVENTION

1. Statement of the Technical Field

The present invention relates to the radio frequency identification (RFID) and more particularly to tracking personal articles via RFID.

2. Description of the Related Art

RFID is an area of automatic identification that has quietly been gaining momentum in recent years and is now being seen as a radical means of enhancing data handling processes, complimentary in many ways to other data capture technologies such bar coding. The object of any RFID system is to carry data in suitable transponders, generally known as tags, and to retrieve data, by machine-readable means, at a suitable time and place to satisfy particular application needs. Data within a tag may provide identification for an item in manufacture, goods in transit, a location, the identity of a vehicle, an animal or individual. By including additional data the prospect is provided for supporting applications through item specific information or instructions immediately available on reading the tag.

An RFID object tracking system requires, in addition to tags, a means of reading or interrogating the tags and some means of communicating the data to a host computer or information management system. In this respect, an RFID object tracking system also can include a facility for programming data into the tags. Notably, the tags can be active and powered in nature, or passive and unpowered in nature. Communication of data between tags and a reader can be by wireless communication. Two methods distinguish and categorize RFID object tracking systems, one based upon close proximity electromagnetic or inductive coupling and one based upon propagating electromagnetic waves. Coupling is via 'antenna' structures forming an integral feature in both tags and readers. While the term antenna is generally considered more appropriate for propagating systems it is also loosely applied to inductive systems.

RFID systems can be roughly grouped into four categories: electronic article surveillance (EAS) systems, portable data capture systems, networked systems and positioning systems. EAS systems typically involve a one bit system used to sense the presence or absence of an item. Portable data capture systems, by comparison, can be characterized by the use of portable data terminals with integral RFID readers and can be used in applications where a high degree of variability in sourcing required data from tagged items may be exhibited. Networked systems applications can generally be characterized by fixed position readers deployed within a given site and connected directly to a networked information management system. The transponders are positioned on moving or moveable items, or people, depending upon application. Finally, positioning systems use transponders to facilitate automated location and navigation support for guided vehicles.

Potential applications for RFID may be identified in virtually every sector of industry, commerce and services where data is to be collected. The attributes of RFID are complimentary to other data capture technologies and thus able to satisfy particular application requirements that cannot be adequately accommodate by alternative technologies. Principal areas of application for RFID that can be currently identified include: transportation and logistics, manufacturing and processing, and security. A range of miscellaneous applications further can be distinguished, including animal tagging, waste management, time and attendance, postal tracking, airline baggage reconciliation, and road toll management.

Despite many of the apparent advantages of RFID technology, deficiencies remain for some potential applications. Specifically, while RFID technology can be effective for garden variety inventory tracking, or for high speed vehicle logging, RFID technology heretofore has not been applied ubiquitously to generalized tracking of personal articles. Yet, in the modern era of accumulated personal articles, individuals must track manually a multiplicity of personal articles at any given time, such personal articles including jewelry, wallets, purses, cellular telephones, pagers, sunglasses and the like. Both the forgetfulness of individuals, in addition to thievery of others can result in the loss of substantially valuable personal articles.

SUMMARY OF THE INVENTION

A method, system and apparatus for locating lost, stolen or misplaced personal articles can overcome the deficiencies of the prior art by locating lost, stolen or misplaced personal articles using the collective efforts of subscribers to a personal articles tracking network. In accordance with a novel and non-obvious system aspect of the present invention, a method for collectively tracking a lost, misplaced or stolen personal article can include distributing a multiplicity of tracking processors to corresponding subscribers in a personal article tracking community. An indication can be received from one of the subscribers in the community that a personal article having an RFID tag has fallen out of range of a tracking processor associated with the one of the subscribers.

An identifier for the RFID tag can be forwarded to other subscribers in the community. Subsequently, notification can be received from at least one of the other subscribers (the "locating subscriber") that the RFID tag has been sensed in proximity to a tracking processor coupled thereto. Optionally, a geographic position can be identified for the locating subscriber when the locating subscriber provides notification that the RFID tag has been sensed. Once identified, the position can be forwarded to the subscriber who had lost the personal article. Additionally, the position can be forwarded to pre-determined third parties such as the police or private security. Finally, an audible alert optionally can be initiated to the locating subscriber when the RFID tag is sensed.

A method for collectively tracking a lost, misplaced or stolen personal article can include receiving an alert specifying tag data for an RFID tag associated with a lost, misplaced or stolen personal article. One or more proximate RFID tags be sensed which have respective coupled personal articles. The specified tag data can be matched to tag data associated with the sensed proximate RFID tags. If a particular one of the sensed proximate RFID tags has tag data which matches the specified tag data, a notification that the lost, misplaced or stolen personal article has been located can be provided in response to the alert.

Optionally, the responding step can include determining an approximate geographic position for the lost, misplaced or stolen personal article and including the position in the notification. As yet another option, the responding step can include including contact information in the notification. In all cases, however, the collective sensing coverage of all subscribers in the network can facilitate the location of the lost, misplaced or stolen personal article.

Notably, the method and system of the present invention can be applied to a fixed region such as a shopping mall or amusement park in which a personal article is to be bound. In this instance, stationary tracking processors can be disposed strategically in fixed locations within the region. Such locations can include kiosks and points of egress. In this way, any attempt to remove a lost, stolen or misplaced personal article from the fixed region can result in an alert at the fixed location. In this regard, the method and system of the present invention can have particular application to the location of lost children.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

The present invention is a collective system for tracking personal articles which have been lost, stolen or otherwise misplaced. In accordance with the present invention, RFID tags, including conventional inventory type RFID tags, can be affixed to personal articles which are to be tracked. A tracking processor distributed to each of a collection of subscribers in a tracking network can sense the presence of the RFID tags. Upon sensing the RFID tags, the tracking processors further can register the corresponding personal articles in a registry or inventory of tracked personal articles. Once an inventory of tracked personal articles has been established, the tracking processor can actively monitor the presence of each tracked personal article to ensure the proximity of the same.

When any one tracked personal article falls outside of a threshold sensing range of the tracking processor, thus becoming "lost", a notification can be transmitted to a centralized monitor either through cellular telephony or wireless data communications. When receiving a notification that a personal article has fallen outside of the threshold sensing range of a tracking processor, the identity of the lost personal article can be transmitted to the other tracking processors belonging to the other subscribers in subscriber base.

Notably, where any one of the tracking processors in the subscriber base detects the presence of a lost personal article, an alert can be generated that a lost personal article has been located within close proximity of the tracking processor. The centralized monitor further can be notified which can relay notification to the owner of the lost personal article. Optionally, the geographic position of the tracking processor can be forwarded to the centralized monitor. In any case, by leveraging the collective tracking capabilities of the subscriber base, an enhanced searching area can be created for locating lost articles. Moreover, the movement of a lost or stolen personal article can be tracked through the sensing capabilities of multiple subscribers whose respective tracking processors can temporarily acquire a signal from the lost or stolen article.

Figure 1:
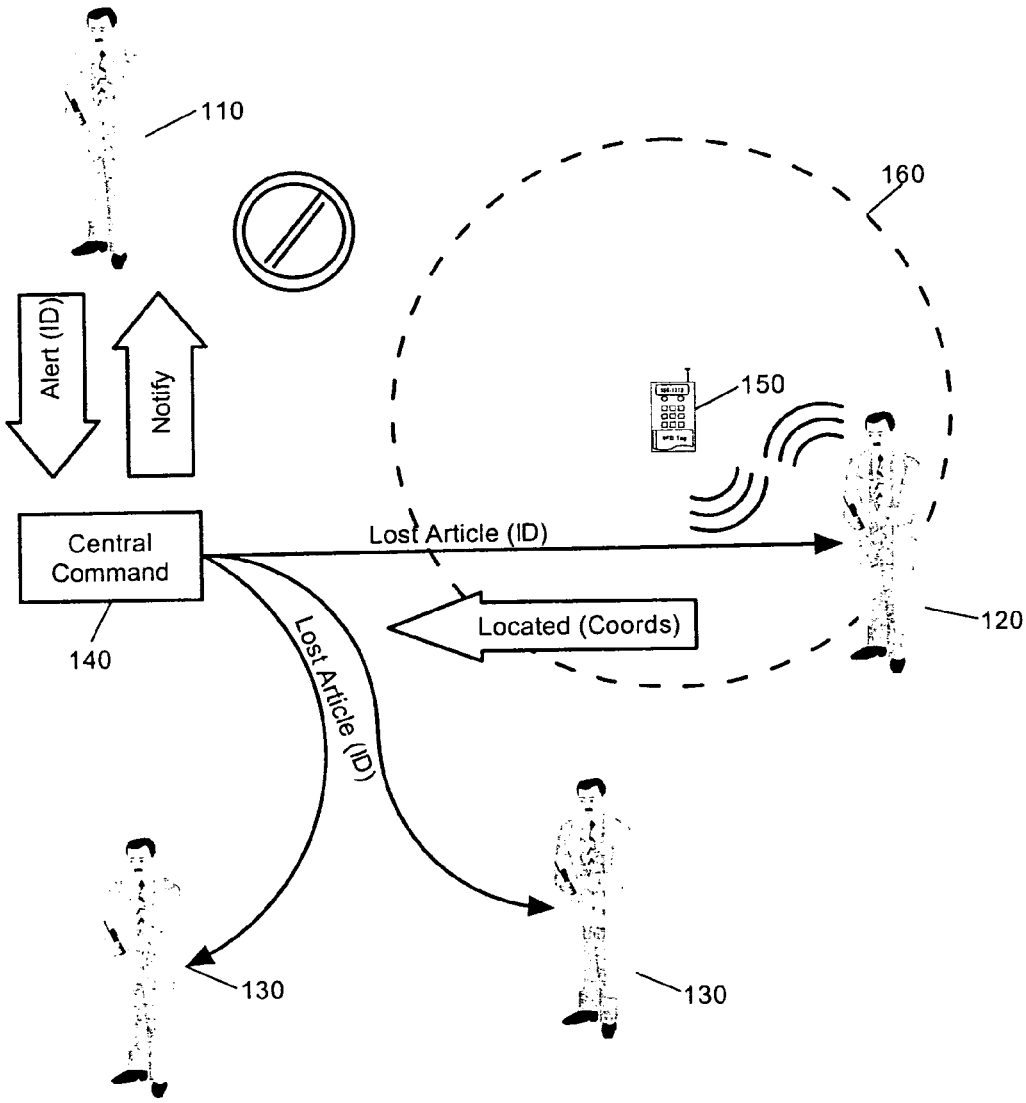
FIG. 1 is a pictorial illustration of a system and process for collective article location.

FIG. 1 is a pictorial illustration of a system and process for collective article location. In operation, a set of subscribers 110, 120, 130 can possess pervasive devices configured to track RFID tags associated with personal articles. Each personal article to be tracked in the system can be coupled to an RFID tag which can report its identification to a tag reader in a tracking processor. Personal articles to be tracked can be registered with a tracking processor in range of the personal articles. Subsequently, when any one of the personal articles falls outside of range of a corresponding tracking processor, an alert can be generated that the personal article has become lost, stolen or misplaced.

In more particular illustration, referring to FIG. 1, a primary subscriber 110 can register the personal article 150 with a respective tracking processor. When the primary subscriber 110 falls outside of the transmission range 160 of the personal article 150, an alert can be generated that the personal article 150 has become "lost". Importantly, a central command 140 can be notified when an alert has been generated. In this regard, a pervasive device coupled to the tracking processor can communicate with the central command wirelessly, for instance through cellular data communications, or through radio frequency data communications. As part of the notification, an identifier associated with the lost personal article 150 can be forwarded to the central command 140.

The central command 140, when receiving an alert notification from the primary subscriber 110, can broadcast a lost article notification to other subscribers 120, 130 in the subscriber base. Specifically, the lost article notification can include the identifier associated with the lost personal article 150 and provided by the primary subscriber 110 to the central command 140. Each of the notified subscribers 120, 130 can actively seek out the lost personal article 150 to determine if the notified subscribers 120, 130 have fallen within the transmission range 160 of the lost personal article 150.

When a locating subscriber 120 falls with the transmission range 160 and detects the proximity of the lost personal article 150, the locating subscriber 120 can be alerted to the proximity of the lost personal article 150. Additionally, the locating subscriber 120 can notify the central command 140 that the lost personal article 150 has been located. Optionally, the position of the locating subscriber 120 further can be reported to the central command 140. In each instance, the central command 140 can report the status of the collective search for the lost personal article to the primary subscriber 110. Importantly, each of the responsive actions of the locating subscriber 120 can be configurable in the sense, for example, that the locating subscriber 120 can prefer not to receive notification of the location of the lost personal article.

Figure 2:
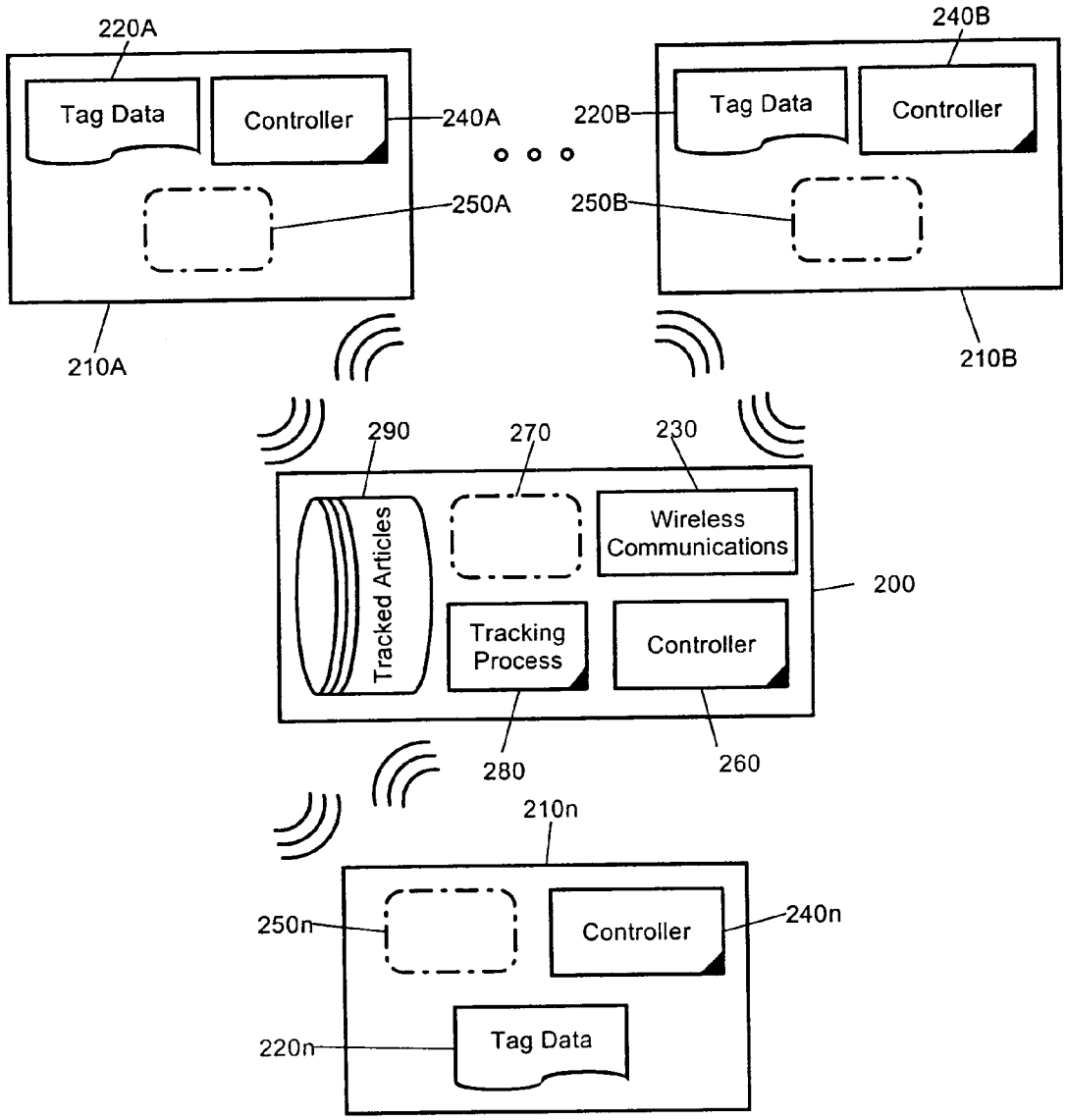
FIG. 2 is a block diagram illustrating an RFID system configured for tracking personal articles in the collective system of FIG. 1.

FIG. 2 is a block diagram illustrating an RFID system configured for tracking personal articles in the collective system of FIG. 1. In accordance with the present invention, one or more personal articles can be coupled to respective RFID tags 210A, 210B, 210*n*. Each RFID tag 210A, 210B, 210*n* can include tag data 220A, 220B, 220*n*, a controller 240A, 240B, 240*n*, and an antenna 250A, 250B, 250*n*. A tracking processor 200 disposed within or in association with a pervasive device such as a PDA or cellular telephone similarly can be configured with an antenna 270 and a controller 260. Moreover, the tracking processor 200 can include a tracking process 280 coupled to a data store 290 configured to store listings of tracked articles. Finally, the tracking processor 200 can include a wireless communications block 230 configured to establish and manage wireless communications between the tracking processor 200 and a central command (not shown).

Each of the RFID tags 210A, 210B, 210*n* can be programmed with tag data 220A, 220B, 220*n* suitable to uniquely identify the respective RFID tags 210A, 210B, 210*n* to an interrogating tracking processor 200. During an interrogation process, the controller 240A, 240B, 240*n* can retrieve the tag data 220A, 220B, 220*n*. Subsequently, the controller 240A, 240B can wirelessly broadcast the tag data 220A, 220B, 220*n* via antennae 250A, 250B, 250*n* to the interrogating device in proximity to the RFID tag 210A, 210B, 210*n*.

In a passive implementation of the present invention, the controller 260 of the tracking processor 200 can broadcast radio frequency energy through antenna 270 so that the antennae 250A, 250B, 250*n* in each of the tags 210A, 210B, 210*n* can become energized. Upon receiving the broadcast radio frequency energy, the controller 240A, 240B, 240*n* can retrieve the tag data 220A, 220B, 220*n*. The controller 240A, 240B, 240*n* subsequently can encode and modulate the retrieved tag data 220A, 220B, 220*n* which can be rebroadcast using the antennae 250A, 250B, 250*n*. The rebroadcast energy can be received through antenna 270. Subsequently, the controller 260 can demodulate and decode the tag data 220A, 220B, 220*n*.

Once the tag data 220A, 220B, 220*n* has been demodulated and decoded, the tracking processor 200 can process the tag data 220A, 220B, 220*n* both to register detected RFID tags 210A, 210B, 210*n* in the data store 290, and also to detect when an already registered RFID tag 210A, 210B, 210*n* no longer can be detected within a threshold range of the tracking processor 200. Additionally, the tag data 220A, 220B, 220*n* of detected ones of the RFID tags 210A, 210B, 210*n* can be compared to a "most wanted" list of tag data to identify those RFID tags associated with lost personal articles.

Figure 3:
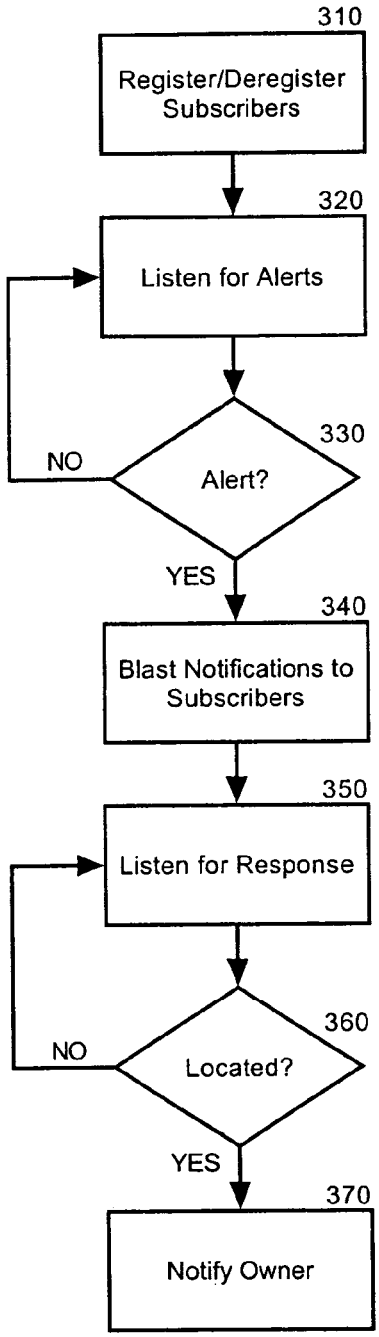
FIG. 3 is a flow chart illustrating a process for collectively tracking a lost, misplaced or stolen personal article in the system of FIG. 1; and, FIG. 4 is a pictorial illustration of the RFID system of FIG. 1 configured for operation within a pre-defined geographic region such as an amusement park, a prison or a shopping center.

To that end, a central command (not shown) can track a set of subscribers each configured with a respective tracking processor 200. The RFID tracking capabilities of each tracking processor 200 can be leveraged among the set of subscribers to establish substantial coverage for locating a lost article. FIG. 3 is a flow chart illustrating a process for collectively tracking a lost, misplaced or stolen personal article in the central command of FIG. 1. Beginning in block 310, a set of subscribers among a subscriber base can be registered and deregistered as individual subscribers become communicatively coupled to and decoupled from the central command.

In block 320, the central command can "listen" for alerts. Specifically, a process within the central command can be established which can detect an alert message transmitted by a tracking processor associated with a registered subscriber. In decision block 330, if an alert is detected, in block 340 an identifier can be extracted from the alert indicating tag data for an RFID tag associated with a lost article. Subsequently, an alert notification can be broadcast to all or a selected group of subscribers in the set such as only those subscribers within geographic proximity to the subscriber who reported the lost, misplaced or stolen article. Importantly, the alert notification can include the extracted tag data.

In block 350 the central command can listen for a response to the broadcast alert. Specifically, for each recipient of the alert notification, the tag data can be compared in the tracking processor to tag data extracted for all RFID tags in range of the tracking processor. Where a match is detected, it can be presumed that the detecting tracking processor is in range of the lost article. Subsequently, the detecting tracking processor can notify the central command that the lost article has been located. In decision block 360, where the central command receives notification that the lost article has been located, in block 370 a notification message can be forwarded to the subscriber who had originally lost the personal article.

Figure 4:
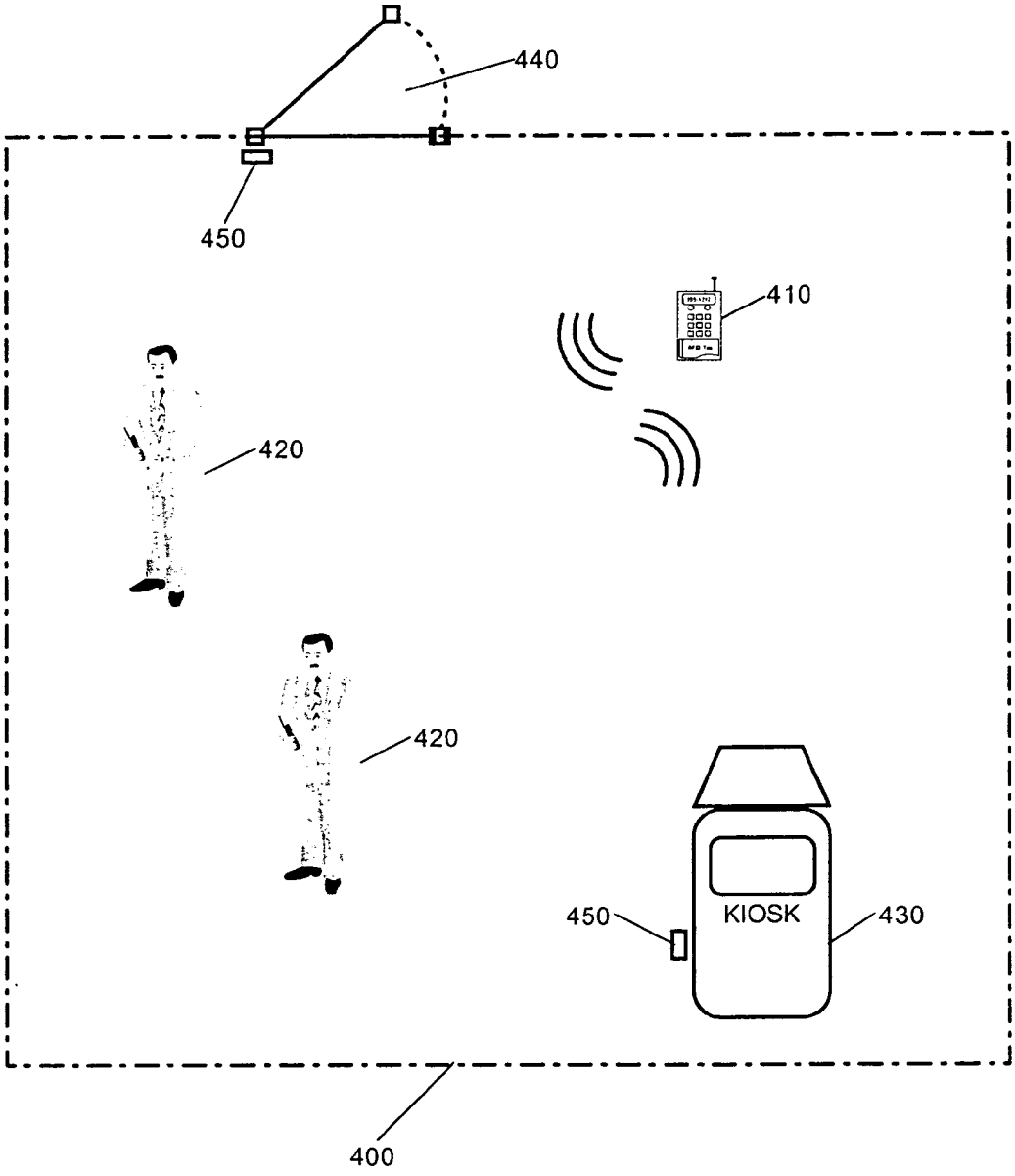

Notably, the system and method of the present invention can be applied to a pre-defined geographic region in which a specific personal article is to be bound. In further illustration, FIG. 4 depicts the configuration of the collective tracking system within a fixed region 400, such as a shopping mall, an amusement park, or a prison. In accordance with the present invention, an RFID tag can be affixed to a personal article 410. The personal article 410 can include not only a cellular telephone, a wallet, and an article of clothing or jewelry, but also a person, such as a small child or a stroller containing a small child. It will be of particular interest to the skilled artisan that the foregoing arrangement have specific application to the location of lost or misplaced children in a shopping mall, an airport, train station, or in an amusement park.

In operation, when it becomes apparent that the personal article 410 has become misplaced, lost or stolen within the fixed region 400, the tracking processor (not shown) responsible for tracking the personal article 410 can alert subscribers 420 within the fixed region 400 of the identity of the personal article 410 so that the subscribers 420 can detect the proximity of the personal article 410 in the fixed region. Additionally, fixed tracking processors 450 disposed strategically within the fixed region 400 can be alerted to the identity of the personal article 410. Importantly, the fixed tracking processors 450 can be strategically disposed at points of egress 440 and at other stationary positions, including kiosks 430. In particular reference to the points of egress 440, when an attempt is made to remove a personal article 410 including a child coupled to the personal article 410 from the fixed region 400 through a point of egress 440, an alert can be generated. In this way, it can be assured that the personal article 410 will remain bound to the fixed region.

Importantly, the invention is not limited to the activation of the collective tracking system when a tracking processor no longer can detect the presence of a tracked personal article 410. Rather, in an alternative embodiment of the present invention, when it becomes apparent that the personal article 410 has been lost or misplaced, the system can be activated manually. In particular, a kiosk 430 disposed within the fixed region 400 can be configured with a tracking interface (not shown). Through the tracking interface, the identity of the lost, misplaced or stolen personal article 410 can be specified giving rise to the activation of the system as described herein.

The method of the present invention can be realized in hardware, software, or a combination of hardware and software. An implementation of the method and system of the present invention can be realized in a centralized fashion in one computer system, or in a distributed fashion where different elements are spread across several interconnected computer systems. Any kind of computer system, or other apparatus adapted for carrying out the methods described herein, is suited to perform the functions described herein.

A typical combination of hardware and software could be a general purpose computer system with a computer program that, when being loaded and executed, controls the computer system such that it carries out the methods described herein. The present invention can also be embedded in a computer program product, which comprises all the features enabling the implementation of the methods described herein, and which, when loaded in a computer system is able to carry out these methods.

Computer program or application in the present context means any expression, in any language, code or notation, of a set of instructions intended to cause a system having an information processing capability to perform a particular function either directly or after either or both of the following a) conversion to another language, code or notation; b) reproduction in a different material form. Significantly, this invention can be embodied in other specific forms without departing from the spirit or essential attributes thereof, and accordingly, reference should be had to the following claims, rather than to the foregoing specification, as indicating the scope of the invention.

We claim:

1. A method for collectively tracking a lost, misplaced or stolen personal article comprising the steps of:

distributing a plurality of tracking processors to corresponding subscribers in a personal article tracking community;

receiving an indication from one of said subscribers in said community that a personal article having a radio frequency identification (RFID) tag has fallen out of range of a tracking processor associated with said one of said subscribers;

forwarding an identifier for said RFID tag to other subscribers in said community; and, receiving notification from at least one of said other subscribers that said RFID tag has been sensed in proximity to a tracking processor coupled to said at least one of said other subscribers.

2. The method of claim 1, further comprising the steps of:

identifying a geographic position for said at least one of said other subscribers when said at least one of said other subscribers provides notification that said RFID tag has been sensed; and, forwarding said position to said one of said subscribers.

3. The method of claim 1, further comprising the step of initiating an audible alert to said at least one of said other subscribers when said RFID tag is sensed.

4. The method of claim 1, wherein said distributing step further comprises the step of establishing stationary tracking processors within a fixed region in which a personal article is to be bound.

5. The method of claim 1, further comprising the step of coupling said personal article to a child.

6. A method for collectively tracking a lost, misplaced or stolen personal article comprising the steps of:

receiving an alert specifying tag data for a radio frequency identification (RFID) tag associated with a lost, misplaced or stolen personal article;

sensing a plurality of proximate RFID tags having respective coupled personal articles;

matching said specified tag data to tag data associated with said sensed proximate RFID tags; and, if a particular one of said sensed proximate RFID tags has tag data which matches said specified tag data, responding to said alert with a notification that said lost, misplaced or stolen personal article has been located.

7. The method of claim 6, wherein said responding step further comprises the steps of:

determining an approximate geographic position for said lost, misplaced or stolen personal article; and, including said position in said notification.

8. The method of claim 6, wherein said responding step further comprises the step of including contact information in said notification.

9. A collective system for tracking a personal article comprising:

at least one radio frequency identification (RFID) tag affixed to a personal article;

a plurality of RFID tracking processors coupled to a corresponding plurality of pervasive devices managed by a corresponding plurality of subscribers; and, a central command communicatively coupled to said pervasive devices.

10. The system of claim 9, further comprising at least one RFID tracking processor disposed at a stationary location within a fixed region.

11. A collective system for tracking a personal article comprising:

at least one radio frequency identification (RFID) tag affixed to a personal article;

a plurality of RFID tracking processors coupled to a corresponding plurality of pervasive devices managed by a corresponding plurality of subscribers; and, a central command communicatively coupled to said pervasive devices, and at least one RFID tracking processor disposed at a stationary location within a fixed region, wherein said stationary location comprises location selected from the group consisting of a point of egress and a kiosk.

12. The system of claim 11, wherein said fixed region comprises a region selected from the group consisting of a shopping mall, an amusement park, an airport, a bus station, and a train station.

13. The system of claim 11, wherein said personal article comprises a wearable article worn by a child.

14. The system of claim 11, wherein said personal article comprises a stroller.

15. A machine readable storage having stored thereon a computer program for collectively tracking a lost, misplaced or stolen personal article, the computer program comprising a routine set of instructions for causing the machine to perform the steps of:

receiving an alert specifying tag data for a radio frequency identification (RFID) tag associated with a lost, misplaced or stolen personal article;

sensing a plurality of proximate RFID tags having respective coupled personal articles;

matching said specified tag data to tag data associated with said sensed proximate RFID tags; and, if a particular one of said sensed proximate RFID tags has tag data which matches said specified tag data, responding to said alert with a notification that said lost, misplaced or stolen personal article has been located.

16. The machine readable storage of claim 15, wherein said responding step further comprises the steps of:

determining an approximate geographic position for said lost, misplaced or stolen personal article; and, including said position in said notification.

17. The machine readable storage of claim 15, wherein said responding step further comprises the step of including contact information in said notification.

* * * * *